United States Patent [19]

Rekewitz et al.

[11] Patent Number: 4,537,521

[45] Date of Patent: Aug. 27, 1985

[54] PAPER FEED MECHANISM WITH VARYING CONTACT PRESSURE

[75] Inventors: Rudolf Rekewitz, Wolfratshausen; Hermann Wambach, Unterhaching, both of Fed. Rep. of Germany

[73] Assignee: Siemens Aktiengesellschaft, Berlin and Munich, Fed. Rep. of Germany

[21] Appl. No.: 545,812

[22] Filed: Oct. 26, 1983

[30] Foreign Application Priority Data

Nov. 5, 1982 [DE] Fed. Rep. of Germany ..... 3240989

[51] Int. Cl.[3] ..... B41J 11/26

[52] U.S. Cl. ..... 400/637.6; 400/637

[58] Field of Search ..... 400/636.3, 634, 636, 400/637, 637.5, 637.6, 638, 578

[56] References Cited

U.S. PATENT DOCUMENTS

| | | | |
|---|---|---|---|
| 784,366 | 3/1905 | Webb | 400/636.3 X |
| 1,371,909 | 3/1921 | Kurowski | 400/636.3 |
| 1,401,103 | 12/1921 | Helmond | 400/636.3 |
| 2,007,360 | 7/1935 | Berger | 400/636 X |
| 4,221,489 | 9/1980 | Engle et al. | 400/636.3 |
| 4,342,521 | 8/1982 | Kuhn | 400/637 |
| 4,364,683 | 12/1982 | Shakib et al. | 400/636.3 X |

FOREIGN PATENT DOCUMENTS

| | | | |
|---|---|---|---|
| 365592 | 12/1922 | Fed. Rep. of Germany . | |
| 1067450 | 10/1959 | Fed. Rep. of Germany . | |
| 1062197 | 4/1954 | France | 400/637 |
| 0018282 | 1/1982 | Japan | 400/636 |
| 0008679 | 1/1983 | Japan | 400/636 |

OTHER PUBLICATIONS

*IBM Technical Disclosure Bulletin*, "Paper-Handling Apparatus for Typewriters and Printers", Jenney et al., vol. 20, No. 12, May 1978, p. 5221.

*Primary Examiner*—Edgar S. Burr
*Assistant Examiner*—James R. McDaniel
*Attorney, Agent, or Firm*—Karl F. Milde, Jr.

[57] ABSTRACT

The paper transport shaft of a paper feed mechanism is movably mounted on an arm of a frame-supported spring wire lever. Another arm of the spring wire lever is pivotably mounted and may be set to flex the body of the spring wire lever through a pivot lever. Depending on the pivoting of the pivot lever the contact pressure between a paper pressure roller mounted on the paper transport shaft and a platen is varied. Selectively, the paper transport shaft can be pivoted away from the platen to allow adjustment of the paper inserted in the paper feed mechanism.

7 Claims, 7 Drawing Figures

PAPER FEED MECHANISM WITH VARYING CONTACT PRESSURE

BACKGROUND OF THE INVENTION

The invention relates to a paper feed mechanism for printing and typing equipment.

In paper feed mechanisms of the type referred to, it is generally known that the paper transport shaft of such mechanisms can be made releasable in order to facilitate insertion of paper into the printing equipment or in order to allow adjustments of the paper already in the printing equipment. Thus, in German patent DE-PS No. 30 14 340 a mechanism for engaging and disengaging a paper transport shaft from a platen of a typewriter is described where by means of locking arrangement the paper transport shaft supported on one side can be pivoted away from the platen for the purpose of transporting edge-perforated paper. When using paper not perforated along the edge, the transport shaft with a transport roller arranged thereon are used for holding the paper against the platen of the printing equipment.

Besides their complicated construction, these known devices have the disadvantage that while they allow engagement and disengagement of the paper transport shaft, they do not allow adjustment of contact pressure between the paper pressure roller of the paper transport shaft and the platen as required for accommodating papers of various types.

Yet, in a typical setting, printing mechanisms are used for the generation of permanent records on paper of various types and sizes. For example, endless paper, endless paper with carbon copies, or single sheets of paper need to be used with the traditional printing equipment mentioned above. It is therefore important to provide an adjustable contact pressure between the paper roller and the platen in order to adapt to different printing mediums and in order to ensure a safe and smooth operation of the printing equipment.

SUMMARY OF THE INVENTION

It is an object of the present invention to provide a paper feed mechanism for the printing equipment referred to above which is capable of handling various types of paper by providing a simple means for adjusting the contact pressure of the paper transport shaft against the platen through a simple lever mechanism.

It is a further object of the present invention to provide a paper feed mechanism which is simple in design and which is highly reliable.

It is still a further object of the present invention to provide a paper feed mechanism which is capable of being used for multiple paper types, by providing for an adjustment of the force by which the various typed papers are being held against the platen of the available printing or typing mechanism.

Accordingly, the invention features in one aspect, a platen, a paper transport shaft on which there is mounted a paper pressure roller, and a frame-supported spring wire lever which has two ends, each shaped as an arm. Basically a paper is inserted between the platen and the paper pressure roller. The paper transport shaft is engaged and supported by one arm of the spring wire lever which is supported by the frame and which may be pivoted in such a manner that the paper pressure roller is pressed against the platen by a pressure which is directly dependent on the degree to which the arm of the spring wire lever has been pivoted. At its other end the arm of the spring wire lever is engaged by a pivot lever which is lockable at a number of positions by an operator. Since the pivot lever is attached to the arm of the spring wire lever, a torsional force is applied to the spring wire lever which is transmitted to its other end and to the paper transport shaft.

Because a paper feed mechanism may comprise several paper transport shafts and paper pressure rollers, the invention features in a preferred embodiment a bearing piece which is used to couple several shafts of the paper transport to the spring wire lever. The bearing piece incorporates a guide recess in which one end of the spring wire lever is received. In actuality the bearing piece rests on top of the spring wire, in a point suspension fashion so that an equalizing effect occurs through which the force from the spring wire lever is transmitted to all the paper transport shafts so that the same force is applied to the paper through the spaced paper pressure rollers along its entire length.

In preferred embodiments, various measures are provided for reducing wear in the bearing piece. For example, the spring wire lever may itself comprise a sliding head of abrasion-resistant material. Or, there may be provided a steel ball which is mounted inside the guide recess and which contacts the end of the spring wire lever. These measures allow the spring wire end to move more easily within the guide recess and also provide for reduced wear during operation of this printing or typing equipment.

In a further embodiment designed to reduce wear in the interface between the spring wire lever and the bearing piece there is provided a spring wire lever with a loop type curvature imparted to its arm in the region of its coupling to the bearing piece. The loop type curvature increases the area of contact between the spring wire lever and the bearing piece and hence reduces the pressure associated with coupling of the lever to the bearing piece.

Other features and advantages of the invention will be apparent from the following description of the preferred embodiments, and from the claims.

For a full understanding of the present invention, reference should now be made to the following detailed description of the preferred embodiments of the invention and to the accompanying drawings.

DETAILED DESCRIPTION

Figure 1:
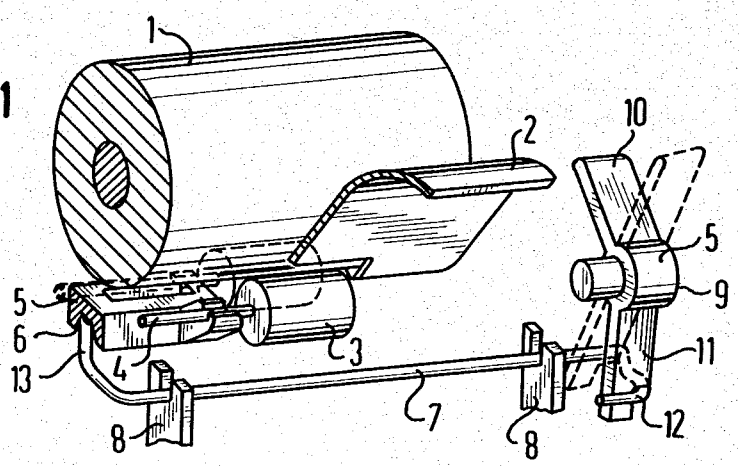
FIG. 1 shows a schematic view of a paper feed mechanism with several paper pressure rollers.

Referring to FIG. 1, there is shown a preferred embodiment of the paper feed mechanism which includes several paper pressure rollers (two are shown). The paper feed mechanism includes a platen 1, an associated paper feed channel 2 and paper pressure rollers 3 arranged below the feed channel 2 and mounted on a spindle 4. Four paper pressure rollers are mounted on spindle 4, but only two are shown in FIG. 1. The spindle 4 itself, in turn, is guided on a bearing piece 5 which is supported through a point suspension accessible through a guide recess 6 on an arm of a spring wire lever 7. The point suspension on the end of the spring wire lever 7 has the function to provide for equalization of the contact pressure of the four paper pressure rollers 3 against the platen 1. The spring wire lever 7 in turn is guided in guides 8 of a frame of the printing equipment not shown here. A rotatably mounted pivot lever 9 consisting of a grip piece 10 and an attachment piece 11 arranged opposite the grip piece rests on an arm 12 of the spring wire lever. Arm 12 may be bent in the manner of a sliding block in such a way that by rotation of the pivot lever 9 the attachment piece 11 deflects the arm 12 and the spring wire lever 7. However, the arm 12 and the spring wire lever are deflected to different degrees. The paper pressure rollers 3 which rest against the platen 1, are pressed against the platen by rotation of the pivot lever 9, a torsional force being applied to the spring wire lever through its spring wire body. If the pivot lever 9 is brought into the position shown in broken lines, the spring wire lever 7 is relieved and hence the paper pressure rollers 3 are pivoted away from the platen 1. Such a pivoting action of the paper pressure rollers 3 is necessary when, for example, the paper is to be straightened or aligned on the platen 1.

Figure 3:
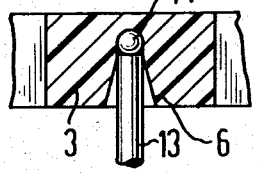

In accordance with the illustrations of FIGS. 3 to 7, various forms of realization are conceivable for the design of the bearing piece 5 with its conically extending guide recess 6. Thus, for example, as shown in FIG. 3, a steel ball 14 may be arranged between end 13 of the spring wire lever and the actual bearing piece 5 made of plastic. It prevents the spring wire lever 7 from penetrating into the soft plastic and serves as an actual bearing element.

Figure 5:
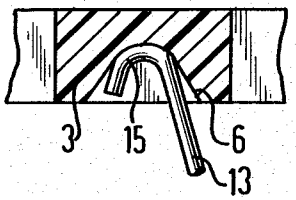
FIGS. 3 to 7 are sectional views of various forms of implementations of the bearing piece which is arranged between the spring wire lever and the paper transport shaft.

If, as shown in FIG. 5, the end 15 of the spring wire lever is given the form of a loop, the compression between the loop-shaped end and the actual bearing piece 5 is reduced. This reduces the wear between the end 13 and the bearing piece 5.

Figure 4:
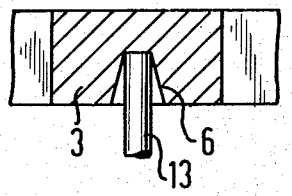
Figure 7:
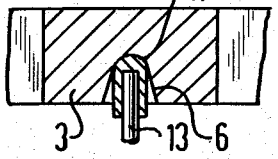
Figure 6:
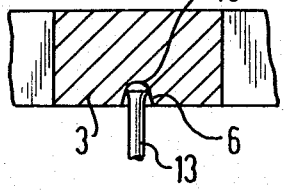

Naturally it is possible also, as shown in FIGS. 4, 6 and 7, to make the bearing piece 5 itself of abrasion-resistant material. This permits, as shown in FIG. 4, direct contact between the end 13 of the spring wire lever and the bearing piece 5.

To be able to pivot the bearing piece, and hence the paper pressure rollers 3 mounted thereon, in all directions, the end 13 of the spring wire lever may be made hemispherical (reference symbol 16) as shown in FIG. 6.

This hemispherical design of the end 13 of the spring wire lever can be also achieved by surrounding the end 13 with an abrasion-resistant hemispherical guide sleeve 17 (FIG. 7). The guide sleeve 17 enlarges the bearing surface of the bearing piece 5 on the spring wire lever 7 and thereby reducing pressures developed in the bearing.

Figure 2:
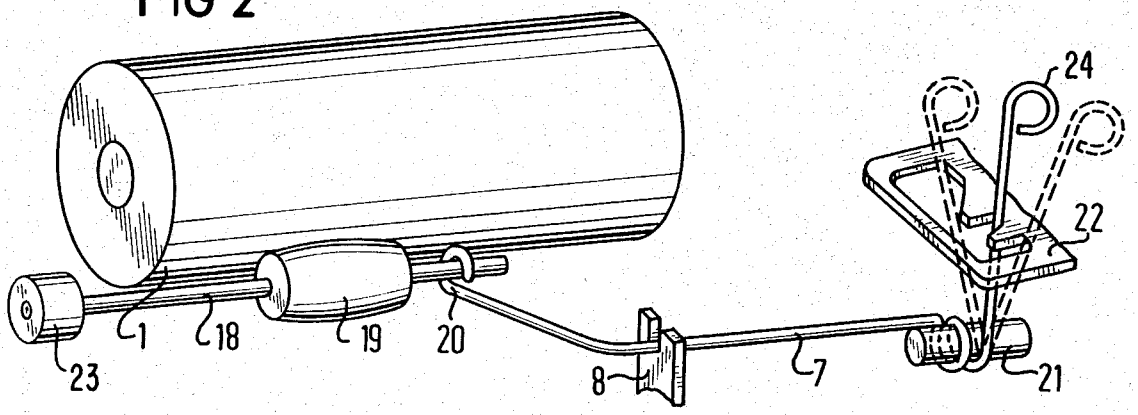
FIG. 2 is a schematic view of a paper feed mechanism with only one paper pressure roller which is guided on a paper transport shaft supported on one side only.

In an embodiment, as shown in FIG. 2, in which printing equipment is used with endless paper, a paper transport shaft 18 is mounted fixed at its one end in a bearing 23 and radially movable at its other end. The transport shaft 18 supports a single barrel-shaped paper pressure roller 19. The radially movable end of the paper transport shaft 18—which is connected via a transmission with the motor-driven platen 1 in a manner not shown in detail here—can be supported directly on the loop-shaped arm 20 of the frame-supported spring wire lever 7.

With the present embodiment, the spring wire lever 7 is supported by a guide 8 secured to the frame, and it is also spirally looped around a guide piece 21 which forms the axis (axle) of the pivot lever 24. In the implementation according to FIG. 2, the pivot lever 24 is part of the spring wire lever 7. The region embracing the guide piece 21 here serves as an additional spring element to support the spring wire lever body. If one provides the sliding block 22 with three notches as shown, the central position of the pivot lever, shown in solid lines, corresponds to the first contact pressure position of the paper pressure roller 19, the left locking position (broken lines), to a position of the paper pressure roller 19 pivoted away from the platen 1, and the position of the pivot lever to the right of the center position (broken lines), to a position with increased contact pressure of the paper pressure roller against the platen. Such a variation of the contact force of the paper pressure roller against the platen 1 may be necessary, for example, when paper of different thickness and different format (e.g. single sheet and endless paper) is to be used in the printing equipment.

There has thus been shown and described a novel apparatus for a paper feed mechanism which fulfills all the object and advantages sought therefor. Many changes, modifications, variations and other uses and application of the subject invention will, however, become apparent to those skilled in the art after considering this specification and the accompanying drawings which disclose preferred embodiment thereof. All such changes, modifications, variations and other uses and applications which do not depart from the spirit and scope of the invention are deemed to be covered by the invention which is limited only by the claims which follow.

What is claimed is:

1. A paper feed mechanism for printing and typing equipment, comprising:

(a) a frame;

(b) a platen;

(c) at least one paper pressure roller support shaft having first and second ends: a first end of said shaft being mounted in said frame;

(d) at least one paper pressure roller mounted on said shaft; and (e) means to vary the force applied by said roller against said platen, said means comprising a frame-supported spring wire lever having first and second arms, the second end of said shaft being supported by said first arm of said spring wire lever, said second arm being pivotally supported and settable at a plurality of predeterminable pivot positions, said spring wire lever being movable to and from an additional predetermined position to move said roller away from and toward said platen whereby both the position of said roller with respect to said platen and the force applied by said roller against said platen may be selectively varied by setting the position of said second arm so that the holding pressure of paper which may be insertable between said platen and said roller is selectively variable.

2. The spring wire lever as recited in claim 1, wherein said wire is rotated around and embraces a pivot axis to realize a spiral spring located at said spring wire lever in the area near said second arm.

3. The paper feed mechanism according to claims 1 or 2, wherein said shaft is fixably mounted at one of its ends and wherein an opposite end of said shaft is mounted at said first arm of said spring wire lever.

4. The paper feed mechanism according to claims 1 or 2, further comprising a bearing piece, said bearing piece being operative for coupling said first arm of said spring wire lever to said shaft, said bearing piece supporting therein said shaft and including a guide recess for receiving therein the end of said first arm of said spring wire lever, said guide recess being operative for suspending said bearing piece on said first arm in a point suspension manner.

5. The paper feed mechanism according to claim 4, further comprising a steel ball arranged within said guide recess, said steel ball being mounted within said guide recess at a point at which said spring wire lever engages said bearing piece.

6. The paper feed mechanism according to claim 4, wherein said first arm of said spring wire lever comprises a sliding head so that said sliding head may engage said bearing piece and move relative thereto with greater ease.

7. The paper feed mechanism according to claim 4, wherein the end portion of said first arm of said spring wire lever is formed in the shape of a loop, said portion in the shape of a loop being operative for engaging said guide recess of said bearing piece.

* * * * *